US009383713B2

(12) United States Patent
Sakon et al.

(10) Patent No.: US 9,383,713 B2
(45) Date of Patent: Jul. 5, 2016

(54) CLEANING BLADE, IMAGE FORMING APPARATUS, AND PROCESS CARTRIDGE

(71) Applicants: Yohta Sakon, Kanagawa (JP); Masahiro Ohmori, Kanagawa (JP); Hiromi Sakaguchi, Kanagawa (JP); Yuka Aoyama, Kanagawa (JP); Masanobu Gondoh, Kanagawa (JP); Shohei Gohda, Ishikawa (JP); Kaori Toyama, Kanagawa (JP); Shinji Nohsho, Tokyo (JP)

(72) Inventors: Yohta Sakon, Kanagawa (JP); Masahiro Ohmori, Kanagawa (JP); Hiromi Sakaguchi, Kanagawa (JP); Yuka Aoyama, Kanagawa (JP); Masanobu Gondoh, Kanagawa (JP); Shohei Gohda, Ishikawa (JP); Kaori Toyama, Kanagawa (JP); Shinji Nohsho, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/808,043

(22) Filed: Jul. 24, 2015

(65) Prior Publication Data

US 2016/0033925 A1 Feb. 4, 2016

(30) Foreign Application Priority Data

Aug. 1, 2014 (JP) ..... 2014-157415

(51) Int. Cl.
*G03G 21/00* (2006.01)

(52) U.S. Cl.
CPC ..... *G03G 21/0017* (2013.01)

(58) Field of Classification Search
CPC ..... G03G 21/0017
See application file for complete search history.

(56) References Cited

U.S. PATENT DOCUMENTS

2009/0311017 A1 12/2009 Ohmori et al.
2011/0217102 A1* 9/2011 Ohmori ..... B08B 1/00 399/350
2013/0243484 A1* 9/2013 Toda ..... G03G 21/0017 399/159
2013/0243506 A1* 9/2013 Ikuno ..... G03G 21/1814 399/350
2013/0243507 A1 9/2013 Sakon et al.
2013/0251401 A1* 9/2013 Asano ..... G03G 5/14795 399/111
2014/0119799 A1* 5/2014 Kabata ..... G03G 21/0017 399/350
2014/0205338 A1 7/2014 Gondoh et al.
2015/0023707 A1* 1/2015 Gohda ..... G03G 21/0017 399/350
2015/0139711 A1 5/2015 Gohda et al.
2015/0212479 A1* 7/2015 Toyama ..... B05D 3/067 399/350
2015/0253722 A1* 9/2015 Sakaguchi ..... G03G 21/0017 399/350
2015/0261171 A1* 9/2015 Gondoh ..... G03G 21/0017 399/111

FOREIGN PATENT DOCUMENTS

JP 2010-152295 7/2010
JP 2013-080075 5/2013
JP 2013-218277 10/2013

* cited by examiner

*Primary Examiner* — G. M. Hyder
(74) *Attorney, Agent, or Firm* — Cooper & Dunham LLP

(57) ABSTRACT

A cleaning blade, including: rectangular elastic body blade containing cured first-UV-curable resin at tip ridgeline portion thereof, brought into contact with surface of to-be-cleaned member, the cured first-UV-curable resin being formed by impregnating the tip ridgeline portion with the first-UV-curable resin, followed by curing, and depth of the elastic body blade impregnated with the first-UV-curable resin from edge surface thereof is 50 μm-150 μm, wherein the elastic body blade contains surface layer containing cured second-UV-curable resin at the edge surface, wherein load-displacement curve of Martens hardness thereof has inflection points, and is obtained by pressing region of the surface layer thereof via resin particles having average particle diameter of 5 μm-10 μm, and distance of the region from the tip ridgeline portion is 0.5 mm or less, and wherein ratio of displacement at the inflection point, with which load is maximum, to the average particle diameter is 1.5-2.0.

12 Claims, 6 Drawing Sheets

CLEANING BLADE, IMAGE FORMING APPARATUS, AND PROCESS CARTRIDGE

BACKGROUND OF THE INVENTION

1. Field of the Invention

The present invention relates to a cleaning blade, an image forming apparatus, and a process cartridge.

2. Description of the Related Art

In an electrophotographic image forming apparatus, conventionally, a toner remained on a surface of a photoconductor after transferring a toner image to a recording medium or an intermediate transfer member is removed by a cleaning device.

As for a cleaning member in a cleaning device, a rectangular elastic body blade is typically used, as a structure of the device can be made simple. Generally, a top end of the rectangular elastic body blade is supported with a holder, and a tip ridgeline portion of the elastic body blade is pressed against a circumferential surface of the photoconductor to block the toner remained on the surface of the photoconductor. The blocked toner is scraped and dropped, to thereby remove the toner from the surface of the photoconductor.

However, the elastic body blade has problems that abrasion resistance thereof is insufficient, and cleaning failure may occur in the normal temperature environment or low temperature environment.

For example, Japanese Patent Application Laid-Open (JP-A) No. 2013-218277 discloses a cleaning blade, which is composed of a rectangular elastic body blade, and is configured to clean a powder from a surface of a member to be cleaned by pressing a tip ridgeline portion of the elastic body blade against the moving surface of the member to be cleaned. In this cleaning blade, an area adjacent to the tip ridgeline portion is impregnated with a UV-curable resin containing a fluorine-based acrylic monomer. Moreover, surface layers harder than the elastic blade are provided to the area adjacent to at least a tip ridgeline portion of a blade bottom surface, which has the tip ridgeline portion at one side thereof and faces a member to be cleaned, and to the area adjacent to at least a tip ridgeline portion of an edge surface parallel to the thickness direction of the elastic blade. Moreover, the impregnation depth of the elastic body blade with the UV-curable resin containing the fluorine-based acrylic monomer from the edge surface is set in the range of 50 [μm] to 150 [μm], and the impregnation depth thereof from the bottom surface of the blade is set in the range of 20 [μm] to 100 [μm].

However, there is still a need for preventing cleaning failures in a low temperature environment.

SUMMARY OF THE INVENTION

The present invention aims to provide a cleaning blade having excellent abrasion resistance, and capable of preventing cleaning failures in a normal temperature environment and low temperature environment.

As the means for solving the aforementioned problems, the cleaning blade of the present invention contains:

a rectangular elastic body blade, wherein the elastic body blade contains a cured first UV-curable resin at a tip ridgeline portion thereof, which is brought into contact with a surface of a member to be cleaned, where the cured first UV-curable resin is formed by impregnating the tip ridgeline portion of the elastic body blade with the first UV-curable resin, followed by curing the first UV-curable resin, and a depth of the elastic body blade impregnated with the first UV-curable resin from an edge surface thereof is 50 μm to 150 μm, wherein the elastic body blade contains a surface layer containing a cured second UV-curable resin at the edge surface thereof, wherein a load-displacement curve of a Martens hardness of the elastic body blade has inflection points, where the load-displacement curve is obtained by pressing a region of the surface layer of the elastic body blade via resin particles having an average particle diameter of 5 μm to 10 μm, and a distance of the region of the surface layer from the tip ridgeline portion is 0.5 mm or less, and wherein a ratio of a displacement at the inflection point, with which a load is maximum, to the average particle diameter of the resin particles is 1.5 to 2.0.

The present invention can provide a cleaning blade having excellent abrasion resistance, and capable of preventing cleaning failures in a normal temperature environment and low temperature environment.

Figure 1:
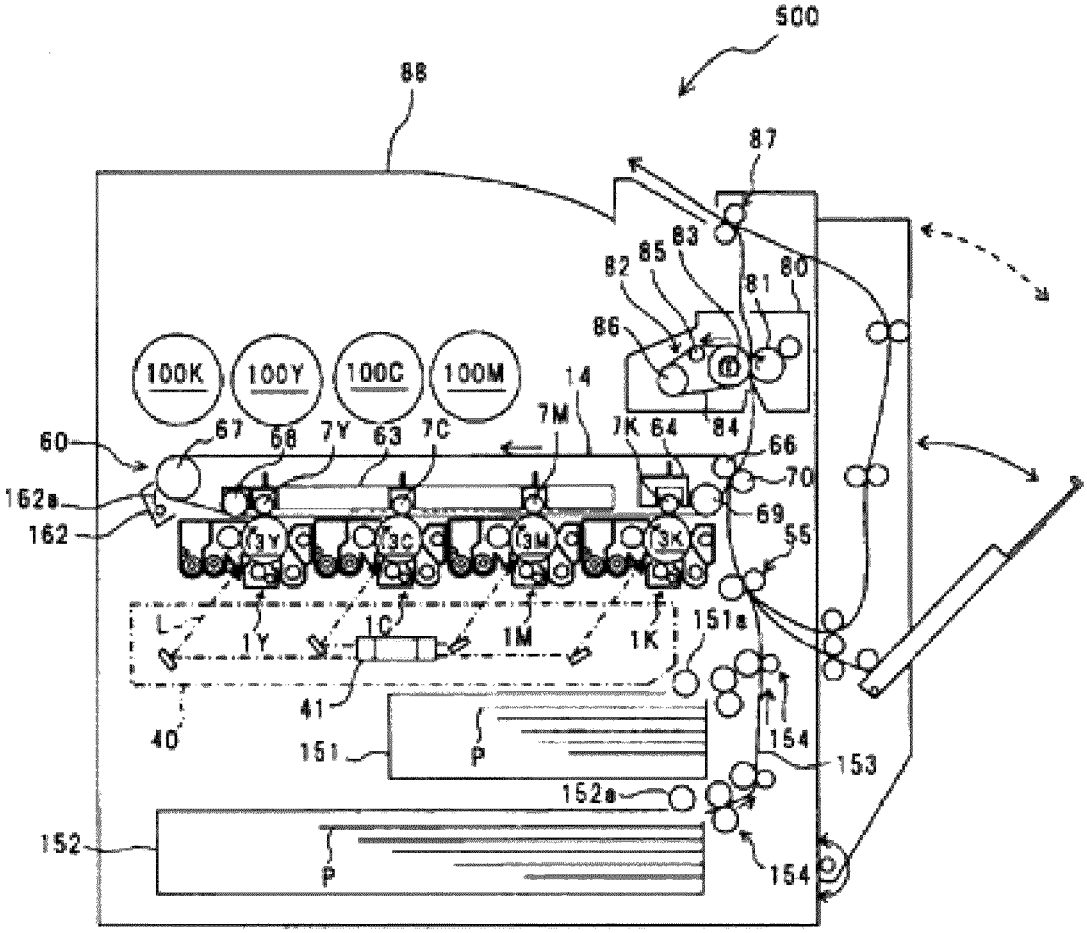
FIG. 1 is a schematic diagram illustrating one example of an image forming apparatus.

DETAILED DESCRIPTION OF THE INVENTION (Cleaning Blade)

The cleaning blade of the present invention contains a rectangular elastic body blade, wherein the elastic body blade contains a cured first UV-curable resin at a tip ridgeline portion thereof, which is brought into contact with a surface of a member to be cleaned, where the cured first UV-curable resin is formed by impregnating the tip ridgeline portion of the elastic body blade with the first UV-curable resin, followed by curing the first UV-curable resin, and a depth of the elastic body blade impregnated with the first UV-curable resin from an edge surface thereof is 50 μm to 150 μm, wherein the elastic body blade contains a surface layer containing a cured second UV-curable resin at the edge surface thereof, wherein a load-displacement curve of a Martens hardness of the elastic body blade has inflection points, where the load-displacement curve is obtained by pressing a region of the surface layer of the elastic body blade via resin particles having an average particle diameter of 5 μm to 10 μm, and a distance of the region of the surface layer from the tip ridgeline portion is 0.5 mm or less, and wherein a ratio of a displacement at the inflection point, with which a load is maximum, to the average particle diameter of the resin particles is 1.5 to 2.0.

A depth of the first UV-curable resin penetrating into a surface (bottom surface), which extends from an edge of the tip ridgeline portion in a direction towards the other fixed end of the elastic body blade is preferably 20 μm to 100 μm.

The cleaning blade is appropriately selected depending on the intended purpose without any limitation, but the cleaning blade is preferably composed of a supporting member, and an elastic member part (fixed end) of which is fixed with the supporting member to have a free end.

The cleaning blade is configured to scrap residues on a surface of a member to be cleaned, by bringing either of the long sides of an edge surface of the free end into conduct with the surface of the member to be creased, to thereby remove the residues.

In the present specification, either of the long sides of the edge surface of the free end is referred to as an abutting side. As the abutting side is brought into contact with a surface of a member to be cleaned, the elastic body blade is deformed and worn. As a result, not only the abutting side, a side surface including the abutting side, and an edge surface of the free end are come to contact with the surface of the member to be cleaned. Therefore, the side surface including the abutting side, and the edge surface of the free end, adjacent to the abutting side, are referred to as a tip ridgeline portion (abutting portion).

A shape, size, and material of the supporting member are appropriately selected depending on the intended purpose without any limitation. The shape of the supporting member is appropriately selected depending on the intended purpose without any limitation, and examples thereof include a plate shape, a strip, and a sheet shape.

The size of the supporting member is not particularly limited, and can be appropriately selected depending on the size of the member to be cleaned. The material of the supporting member is appropriately selected depending on the intended purpose without any limitation, and examples thereof include metal, plastic, and ceramic. Among them, a metal plate is preferable in view of a strength thereof, and a steel (e.g., stainless steel) plate, an aluminium plate, and a phosphor bronze plate are particularly preferable.

A shape, structure, size, and material of the member to be cleaned are appropriately selected depending on the intended purpose without any limitation. Examples of the member to be cleaned include an image bearer (e.g., a photoconductor).

The shape of the member to be cleaned is appropriately selected depending on the intended purpose without any limitation, and examples thereof include a drum shape, a belt shape, a plate shape, and a sheet shape.

The size of the member to be cleaned is appropriately selected depending on the intended purpose without any limitation, but preferred is about a size typically used.

The material of the member to be cleaned is appropriately selected depending on the intended purpose without any limitation, and examples thereof include metal, plastic, and ceramic.

The residues are appropriately selected depending on the intended purpose without any limitation, provided that they are deposited on a surface of the member to be cleaned, and become a removal target for the cleaning blade. Examples thereof include a toner, lubricant, inorganic particles, organic particles, foreign matter, dusts, and a mixture thereof.

Next, embodiments for carrying out the present invention are explained with reference to drawings.

One example of the image forming apparatus is illustrated in FIG. 1.

The image forming apparatus 500 is equipped with four image formation units 1Y, 1C, 1M, 1K of yellow (Y), magenta (M), cyan (C), and black (K), respectively. The image formation units 1Y, 1C, 1M, 1K have the same structure, provided that a color of the toner for use is different.

A transfer unit 60 equipped with an intermediate transfer belt 14 is provided at the upper side of the image formation units 1Y, 1C, 1M, 1K. Toner images of the aforementioned colors formed on surfaces of the photoconductors 3Y, 3C, 3M, 3K contained in the image formation units 1Y, 1C, 1M, 1K are transferred and superimposed on a surface of the intermediate transfer belt 14.

Moreover, an exposure unit 40 is provided at the bottom side of the image formation units 1Y, 1C, 1M, 1K. The exposure unit 40 is configured to irradiate the photoconductors 3Y, 3C, 3M, 3K with laser light L based on image information. As a result of the exposure, electrostatic latent images are formed on the photoconductors 3Y, 3C, 3M, 3K, respectively. The exposure unit 40 is configured to apply laser light L to the photoconductors 3Y, 3C, 3M, 3K through a plurality of optical lenses or mirrors, while polarizing the light with a polygon mirror 41 that is rotationally driven by a motor.

Note that, the exposure unit 40 may perform light scanning with an LED array.

At the bottom of the exposure unit 40, a first paper feeding cassette 151 and a second paper feeding cassette 152 are provided in a manner that they are overlapped in the vertical direction. In each of the first paper feeding cassette 151 and the second paper feeding cassette 152, recording media P are housed in the state of a paper bundle where a plurality of sheets are stacked. A recording medium P placed on the top in each cassette is in contact with a first paper feeding roller 151*a* and a second paper feeding roller 152*a*, respectively. Once the first paper feeding roller 151*a* is rotationally driven in the anticlockwise direction of the diagram by a driving unit (not illustrated), a recording medium P placed on top in the first paper feeding cassette is discharged to a paper feeding path 153 provided in the vertical direction at the right side of the first paper feeding cassette 151. Once the second paper feeding roller 152*a* is rotationally driven in the anticlockwise direction of the diagram by a driving unit (not illustrated), moreover, a recording medium P placed on top in the second paper feeding cassette 152 is discharged to the paper feeding path 153.

Pluralities of a pair of convey rollers 154 are provided in the paper feeding path 153. The recording medium P sent to the paper feeding path 153 is conveyed from the bottom to the top within the paper feeding path 153 in the drawing with being nipped with the pair of the convey rollers 154.

A pair of registration rollers 55 is provided at the downstream end part of the paper feeding path 153 relative to the traveling direction of the recording medium P. Once the pair of the registration rollers 55 nip therebetween the recording medium P transported from the pair of the convey rollers 154, the rotation of the pair of the convey rollers 154 is stopped temporarily. Then, the recording medium P is sent to the below-mentioned secondary transfer nip at the appropriate timing.

Figure 2:
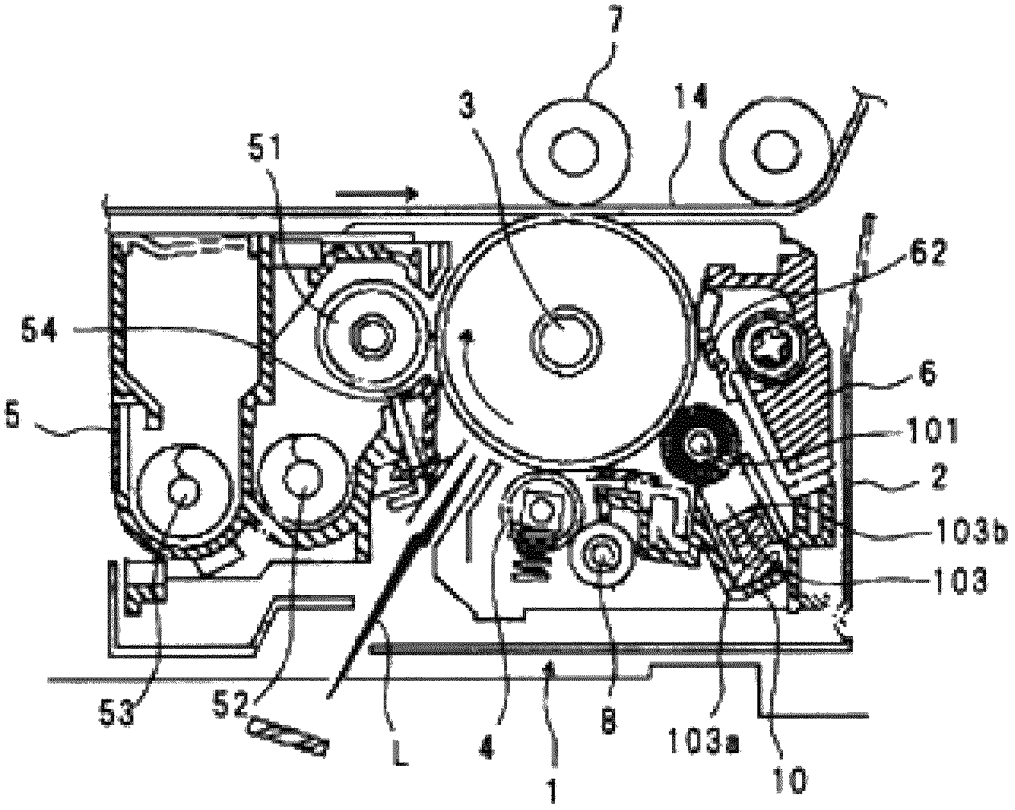
FIG. 2 is a schematic diagram illustrating one example of the image formation unit of FIG. 1.

The image formation unit 1 is illustrated in FIG. 2.

The image formation unit 1 is equipped with a drum-shaped photoconductor 3.

Note that, the photoconductor 3 may be a sheet-type photoconductor or an endless belt-type photoconductor.

In the surrounding area of the photoconductor 3, a charging roller 4, a developing device 5, a primary transfer roller 7, a cleaning device 6, a lubricant coating device 10, and a charge neutralization lamp (not illustrated) are provided.

The charging roller 4 is a charging member equipped in a charging device.

The developing device 5 is configured to develop an electrostatic latent image formed on a surface of the photoconductor 3 with a toner to form a toner image.

The primary transfer roller 7 is a primary transfer member equipped in a primary transfer device, which is configured to transfer the toner image formed on a surface of the photoconductor 3 to an intermediate transfer belt 14.

The cleaning device 6 is configured to clean the toner remained on the surface of the photoconductor 3, from which the toner image has been transferred to the intermediate transfer belt 14.

The lubricant coating device 10 is configured to apply a lubricant onto the cleaned surface of the photoconductor 3.

The charge neutralization lamp (not illustrated) is configured to neutralize the surface potential of the cleaned photoconductor 3.

The charging roller 4 is provided in a non-contact manner, with a certain space to the photoconductor 3, and is configured to charge the photoconductor 3 with the predetermined polarity and predetermined potential. The laser light L is emitted from the exposure unit 40 to a surface of the photoconductor 3, which has been uniformly charged by the charging roller 4, based on image information, to thereby form an electrostatic latent image.

The developing device 5 contains a developing roller 51. To the developing roller 51, developing bias is applied from a power source (not illustrated). In a casing of the developing device 5, provided are a supply screw 52 and a stirring screw 53, which are configured to stir a developer housed in the casing, white transporting in the mutually different directions. Moreover, also provided is a doctor 54 configured to regulate the developer held on the developing roller 51. The toner in the developer stirred and transported by the supply screw 52 and the stirring screw 53 is charged to the predetermined polarity. The developer is then scooped on a surface of the developing roller 51, the scooped developer is regulated by the doctor 54, and the toner is deposited on an electrostatic latent image formed on a surface of the photoconductor 3 in the developing region facing to the photoconductor 3.

The cleaning device 6 contains a cleaning blade 62. The cleaning blade 62 is brought into contact with the photoconductor 3 in a counter direction to the travelling direction of the surface of the photoconductor 3.

The lubricant coating device 10 is equipped with a solid lubricant 103 and a lubricant press spring 103*a*, and is further equipped with a fur brush 101 configured to apply the solid lubricant 103 on a surface of the photoconductor 3. The solid lubricant 103 is held by a bracket 103*b*, and is pressed to the side of the fur brush 101 by the lubricant press spring 103*a*. Then, the solid lubricant 103 is scraped with the fur brush 101, which rotates in the dragging direction relative to the rotational direction of the photoconductor 3, and the scraped lubricant is applied to the surface of the photoconductor 3. As a result, the friction coefficient of the surface of the photoconductor 3 is maintained to 0.2 or less, when an image is not formed.

Note that, the charging device is that of a non-contact adjacent setting type, where the charging roller 4 is provided adjacent to the photoconductor 3. However, the charging device may be corotron, scorotron, or a solid state charger.

A light source of laser light L of the exposure unit 40, and a light source of the charge neutralization lamp are not particularly limited, and examples thereof include a fluorescent lamp, a tungsten lamp, a halogen lamp, a mercury lamp, a sodium lamp, a light-emitting diode (LED), a laser diode (LD), and an electroluminescent (EL) lamp. Among them, preferred are a light-emitting diode (LED) and a laser diode (LD), because they can apply light having a wavelength of 600 nm to 800 nm.

A filter may be used in combination with the exposure unit 40 in order to apply only light having the desired wavelength range.

The filter is not particularly limited, and examples thereof include a sharp-cut filter, a band filter, a near infrared-cut filter, a dichroic filter, an interference filter, and a color temperature conversion filter.

The transfer unit 60 is equipped with an intermediate transfer belt 14, a belt-cleaning unit 162, a first bracket 63, and a second bracket 64. Moreover, the transfer unit 60 is further equipped with primary transfer rollers 7Y, 7C, 7M, 7K, a secondary transfer back-up roller 66, a driving roller 67, a support roller 68, and a tension roller 69.

The intermediate transfer belt 14 is rotated in an anticlockwise direction in the drawing by the rotational driving of the driving roller 67, while supported by the primary transfer rollers 7Y, 7C, 7M, 7K, the secondary transfer back-up roller 66, the driving roller 67, the support roller 68, and the tension roller 69. The primary transfer rollers 7Y, 7C, 7M, 7K nip the intermediate transfer belt 14 with the photoconductors 3Y, 3C, 3M, 3K, respectively, to thereby form primary transfer nips, respectively. Then, a transfer bias having an opposite polarity to that of the toner is applied to the back surface of the intermediate transfer belt 14 (the internal perimeter surface of the loop). In the process that the intermediate transfer belt 14 successively passes through the primary transfer nips, the toner images formed on the surfaces of the photoconductors 3Y, 3C, 3M, 3K are superimposed on the surface of the intermediate transfer belt 14 (the outer perimeter surface of the loop) to thereby perform primary transfer. As a result, the toner image (superimposed toner images) is formed on the surface of the intermediate transfer belt 14.

The secondary transfer back-up roller 66 nips the intermediate transfer belt 14 with the secondary transfer roller 70 provided at the outer side of the loop of the intermediate transfer belt 14, to thereby form a secondary transfer nip. A pair of registration rollers 55 sends a recording medium P, which has been nipped between the pair of the registration rollers 55, to the secondary transfer nip at timing to synchronize to the toner image formed on the surface of the intermediate transfer belt 14. The toner image formed on the surface of the intermediate transfer belt 14 is secondary transferred to the recording medium P in the secondary transfer nip by influences of a secondary transfer electric field formed between the secondary transfer roller 70 and the secondary transfer back-up roller 66, to which secondary transfer bias is applied, or nip pressure.

The toner, which has not been transferred to the recording medium P, is deposited on the intermediate transfer belt 14, which has passed through the secondary transfer nip. Therefore, the intermediate transfer belt 14 is cleaned by the cleaning unit 162. Note that, the cleaning unit 162 contains a cleaning blade 162*a* that is brought into contact with the surface of the intermediate transfer belt 14 (the outer perimeter surface of the loop) to scrape and remove the toner remained on the surface of the intermediate transfer belt 14.

The first bracket 63 is rocked at the predetermined rotational angle by on-off driving of a solenoid (not illustrated) with the rotational axis of the support roller 68 as a center. In the case where the 500 forms a monochromic image, the first bracket 63 is rotated only a little in an anticlockwise direction in the drawing by the driving of the solenoid. Specifically, the intermediate transfer belt 14 is separated from the photoconductors 3Y, 3C, 3M by rotating the primary transfer rollers 7Y, 7C, 7M in the anticlockwise direction in the drawing with the rotational axis of the support roller 68 being a center. Then, a monochromic image is formed by driving only the image formation unit 1K. As a result, consumptions of other members, which will be caused by driving the image formation units 1Y, 1C, 1M, can be avoided, when a monochromic image is formed.

The fixing unit 80 is provided at the upper side of the secondary transfer nip in the drawing. The fixing unit 80 is equipped with a press heat roller 81, which includes therein a heat source, such as a halogen lamp, and a fixing belt unit 82. The fixing belt unit 82 has a fixing belt 84, a heat roller 83, which includes therein a heat source, such as a halogen lamp, a tension roller 85, a driving roller 86, and a temperature sensor (not illustrated). The fixing belt 84 travels in an anticlockwise direction in the drawing, with supported by the heat roller 83, the tension roller 85, and the driving roller 86.

In this process, the fixing belt 84 is heated from the side of the back surface (the internal perimeter surface of the loop) by the heat roller 83. The press heat roller 81, which is rotationally driven in the clockwise direction in the drawing, is brought into contact with the surface of the fixing belt 84 (the outer perimeter surface of the loop) at the position where the fixing belt 84 is supported by the heat roller 83. As a result, a fixing nip, at which the press heat roller 81 and the fixing belt 84 are brought into contact with each other, is formed.

The temperature sensor (not illustrated) is provided at the outer side of the loop of the fixing belt 84 in the manner that, the temperature sensor faces to the surface of the fixing belt 84 (the outer perimeter of the loop) with the predetermined space, and the temperature sensor detects the surface temperature of the fixing belt 84 just before entering the fixing nip. The detected result is sent to the fixing power source circuit (not illustrated). The fixing power source circuit controls, with on-off, a heat source included in the heat roller 83, or a heat source included in the press heat roller 81, based on the detected result of the temperature sensor.

Meanwhile, the recording medium P passed through the secondary transfer nip P is separated from the intermediate transfer belt 14, followed by sending the recording medium P into the fixing unit 80. The recording medium P is then nipped at the fixing nip in the fixing unit 80 to be transported from the bottom side to the upper side in the drawing. In this process, the recording medium P is heated, as well as pressed by the fixing belt 84, to thereby fix the toner image onto the recording medium P.

The recording medium P, to which the toner is fixed, is passed through a pair of paper ejection rollers 87, and is then discharged outside the apparatus. A stacking unit 88 is formed on the top surface of the housing of the main body of the image forming apparatus 500. The recording media P discharged outside the apparatus by the pair of the paper ejection roller 87 are sequentially stacked in the stacking unit 88.

Toner cartridges 100Y, 100C, 100M, 100K, each configured to house therein a toner, are provided above the transfer unit 60. The toners in the toner cartridges 100Y, 100C, 100M, 100K are appropriately supplied to the developing devices 5Y, 5C, 5M, 5K, respectively. The toner cartridges 100Y, 100C, 100M, 100K are mounted independently to the image formation units 1Y, 1C, 1M, 1K, and can be detachably mounted in the main body of the image forming apparatus 500.

Next, image forming operations performed with the image forming apparatus 500 are explained.

Once a signal for a print execution from an operation unit is received, first, the predetermined voltage or electric current is applied to the charging roller 4 and the developing roller 51 successively at the predetermined timings. Similarly, the predetermined voltage or electric current is applied to a light source of the exposure unit 40 and a light source of the charge neutralization lamp successively at the predetermined timings. In the synchronized motions to this, the photoconductor 3 is rotationally driven in the direction shown with the arrow in the drawing by a photoconductor driving motor (not illustrated).

Once the photoconductor 3 is rotated in the direction shown with the arrow in the drawing, a surface of the photoconductor 3 is uniformly charged to the predetermined potential by the charging roller 4. Then, laser light L is applied to the surface of the photoconductor 3 from the exposure unit 40 corresponding to the image information. As a result, the area of the surface of the photoconductor 3, to which the laser light L is applied, is discharged, to thereby form an electrostatic latent image.

The surface of the photoconductor 3, on which the electrostatic latent image has been formed, is rubbed by a magnetic brush, which is composed of a developer and formed on the developing roller 51, in the region facing to the developing device 5. In this operation, the charged toner on the developing roller 51 is transported to the side of the elastic latent image by the predetermined developing bias applied to the developing roller 51, to thereby develop the electrostatic latent image. The similar image formation process is performed in the image formation units 1Y, 1C, 1M, 1K, and the toner images of respective colors are formed on the surfaces of the photoconductors 3Y, 3C, 3M, 3K.

As mentioned above, the electrostatic latent image formed on the surface of the photoconductor 3 is reverse developed with the charged toner by the developing device 5 in the image forming apparatus 500.

Note that, an N/P (negative-positive) non-contact charging roller system where a toner is deposited on an area having the lower potential is explained above, but a system for use is not limited to the aforementioned system.

The toner images of respective colors formed on the surfaces of the photoconductors 3Y, 3C, 3M, 3K are sequentially primary transferred so that they are superimposed on a surface of the intermediate transfer belt 14. As a result, the toner image (superimposed toner images) is formed on the surface of the intermediate transfer belt 14.

The toner image formed on the surface of the intermediate transfer belt 14 is transferred to a recording medium P, which is fed from the first paper feeding cassette 151 or the second paper feeding cassette 152, and is fed to the secondary transfer nip with going through between the pair of the registration rollers 55. During this operation, the recording medium P is temporarily stopped with being nipped between the pair of the registration rollers 55, is synchronized with the edge of the image on the intermediate transfer belt 14, and is supplied to the secondary transfer nip. The recording medium P, to which the toner image has been transferred, is separated from the intermediate transfer belt 14, and is sent to the fixing unit 80. As the recording medium P, to which the toner image has been transferred, passes through the fixing unit 80, the toner image is fixed on the recording medium P by heat and pressure. The recording medium P, to which the toner image has been fixed, is discharged outside the image forming apparatus 500, and is stacked in the stacking unit 88.

Meanwhile, the toner remained on the surface of the intermediate transfer belt 14, from which the toner image has been transferred to the recording medium P at the secondary transfer nip, is removed by the cleaning unit 162.

Moreover, the toner remained on the surface of the photoconductor 3, from which the toner image has been transferred to the intermediate transfer belt 14 at the primary transfer nip, has been removed by the cleaning device 6. Thereafter, a lubricant is applied to the surface of the photoconductor 3 by the lubricant coating device 10, followed by discharging the surface thereof by the charge neutralization lamp.

The image formation unit 1 is composed of the photoconductor 3, and as process units, the charging roller 4, the developing device 5, the cleaning device 6, and the lubricant coating device 10, all of which are housed in a frame body 2. The image formation unit 1 is detachably mounted, as a process cartridge, in the main body of the image forming apparatus 500.

In the image forming apparatus 500, the image formation unit 1 has a configuration that the photoconductor 3 and the process units are integratedly exchanged as a process cartridge. However, a configuration for use may be a configuration where the photoconductor 3, the charging roller 4, the developing device 5, the cleaning device 6, and the lubricant coating device 10 are individually exchanged per unit.

The recording medium P is not particularly limited, and examples thereof include plane paper.

Note that, the transfer system of the image forming apparatus is not limited to an intermediate transfer system, and a direct transfer system may be employed.

Figure 3:
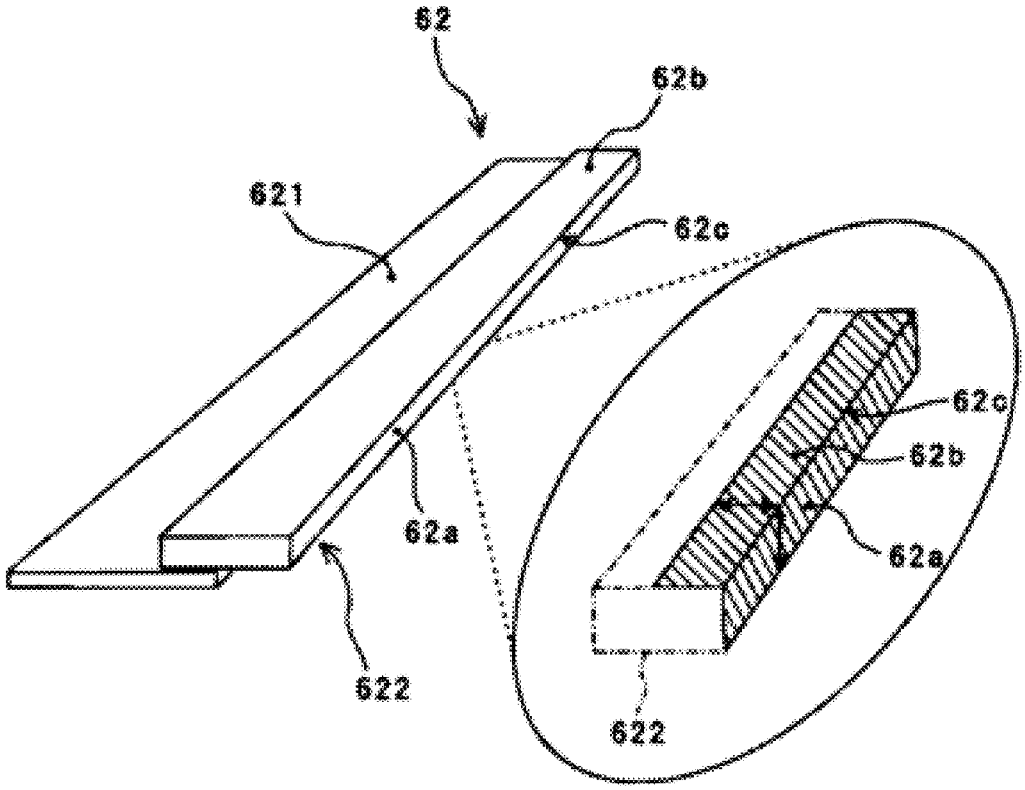
FIG. 3 is a perspective view illustrating one example of the cleaning blade of FIG. 2.
Figure 4:
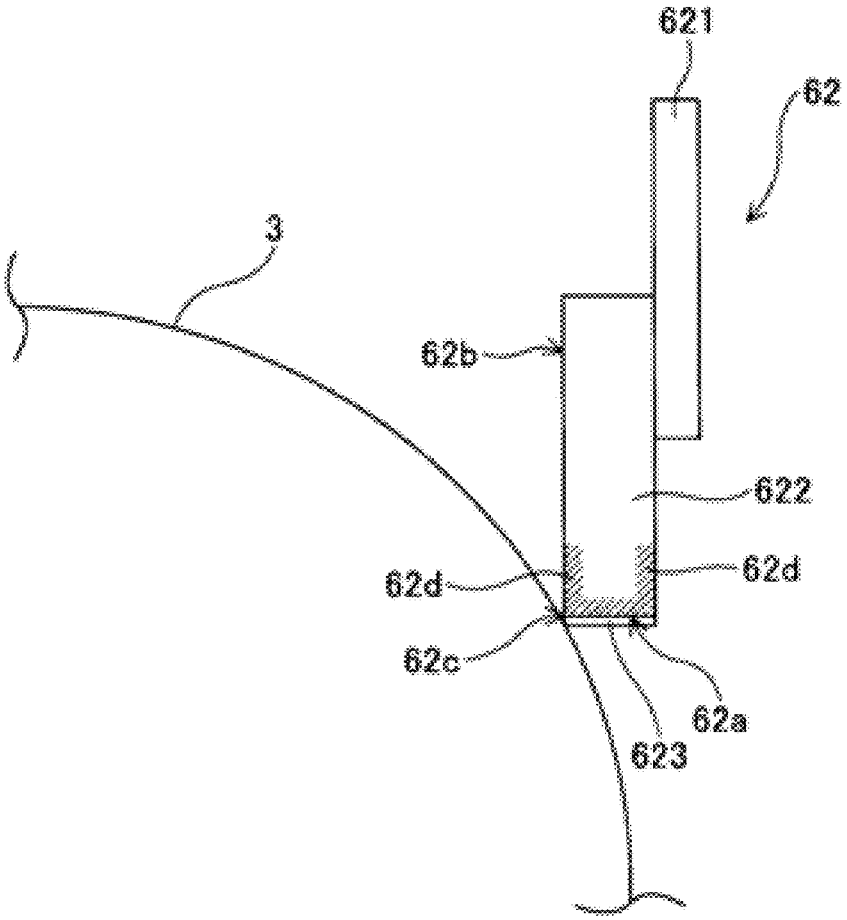
FIG. 4 is an enlarged cross-sectional view illustrating one example of a state where the cleaning blade of FIG. 2 is in contact with a surface of a photoconductor.
Figure 5:
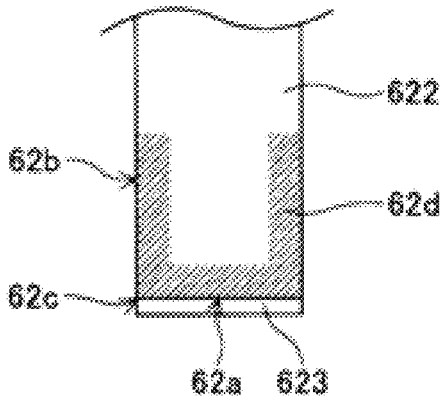
FIG. 5 is an enlarged view illustrating one example of a section around the elastic member of FIG. 2.

The cleaning blade 62 is illustrated in FIG. 3. Moreover, a state where the cleaning blade 62 is brought into contact with a surface of the photoconductor 3 is illustrated in FIG. 4. Furthermore, FIG. 5 depicts the section adjacent to the contact part of the elastic body blade 622.

The cleaning blade 62 is composed of a rectangular holder 621, and a rectangular elastic body blade 622, and is brought into contact with a surface of the photoconductor 3 in a counter manner. The elastic body blade 622 is supported by fixing the top end of the elastic body blade 622 onto the bottom end of the holder 621 with an adhesive, and the top end of the holder 621 is supported with a casing of the cleaning device 6 in a manner of a cantilever.

A material for constituting the holder 621 is not particularly limited, and examples thereof include a rigid material, such as metal, and hard plastic.

A material for constituting the elastic body blade 622 is not particularly limited, as long as it is a material that can correspond to eccentricity of the photoconductor 3, and fine surface waviness of the photoconductor 3. Examples of the material include urethane rubber.

A production method of the urethane rubber is not particularly limited, and examples thereof include centrifugal forming.

As for raw materials of the urethane rubber, preferably used are polyol having the OH value of 28 mgKOH/g to 168 mgKOH/g and containing two or three hydroxyl groups, diisocyanate (e.g., TDI, MDI, IPDI, HDI, NDI, and TODI), and a short-chain polyol having the Oh value of 950 mgKOH/g to 1,830 mgKOH/g (e.g., ethylene glycol, propane diol, butane diol, pentane diol, hexane diol, glycerin, trimethylol ethane, and trimethylol propane).

For example, the elastic body blade can be produced by injecting raw materials of the urethane rubber into a centrifugal forming mold heated to 100° C. to 200° C., curing the rubber for the predetermined period, removing the rubber from the mold, leaving the rubber to stand for 1 week in the high temperature high humidity environment (e.g., 30° C., 85% RH), and cutting into the predetermined shape.

JIS A hardness of the urethane rubber at 25° C. is typically 68 degrees to 80 degrees. As the JIS A hardness of the urethane rubber at 25° C. is 68 degrees or greater, so-called belly abutting hardly occurs. The belly abutting is that the cleaning blade 62 is warped, when the contact pressure is set high, and hence the tip ridgeline portion 62*c* is lifted, and the bottom surface 62*b* of the cleaning blade 62 comes to contact with the photoconductor 3. As a result of this, cleaning performance can be improved. As the JIS A hardness of the urethane rubber at 25° C. is 80 degrees or less, moreover, so-called uneven abutting hardly occurs, even when the elastic body blade 622 is mounted to the holder 621 in the state where the holder 621 is tilted. The uneven abutting is that the contact pressure is different at one end of the cleaning blade 62 and the other end thereof relative to the rotational axis direction of the photoconductor 3. As a result of this, cleaning performance can be improved.

Note that, the bottom surface 62*b* and the edge surface 62*a* are surfaces of the elastic body blade 622 facing the photoconductor 3.

The elastic body blade 622 may be a laminate of two different types of urethane rubber. The JIS A hardness of the two different types of the urethane rubber is both typically 68 degrees to 80 degrees. However, appropriate raw materials of urethane rubber can be selected at a side of the elastic body blade 622, which is brought into contact with the photoconductor 3, and at a side thereof not to be brought into contact with the photoconductor 3. In this case, the two different types of the urethane rubber can be formed integratedly by continuously injecting raw materials of the two different types of the urethane rubber before each layer is completely cured. As a result of this, pealing between layers can be prevented.

After the edge portion 62*d* of the elastic body blade 622 is impregnated with the first UV-curable resin, the first UV-curable resin is cured. As a result, the tip ridgeline portion 62*c* of the elastic body blade 622, which is to be in contact with the photoconductor 3, can be prevented from being deformed in the traveling direction of the surface of the photoconductor 3. As a result, abrasion resistance can be improved.

The depth of the elastic body blade impregnated with the first UV-curable resin from the edge surface 62*a* is typically 50 μm to 150 μm. As the depth of the elastic body blade impregnated with the first UV-curable resin from the edge surface 62*a* is 50 μm or greater, the tip ridgeline portion 62*c* of the elastic body blade 622 can be prevented from being rolled up. As the depth of the elastic body blade impregnated with the first UV-curable resin from the edge surface 62*a* is 150 μm or less, moreover, abrasion of the tip ridgeline portion 62*c* of the elastic body blade 622 can be prevented.

A depth of the first UV-curable resin penetrating into a surface (bottom surface) 62*b*, which extends from the edge of the tip ridgeline portion in the direction towards the fixed end of the elastic blade, is typically 20 μm to 100 μm. When the depth of the first UV-curable resin penetrating into the bottom surface 62*b* is 20 μm or greater, the tip ridgeline portion 62*c* of the elastic body blade 622 can be prevented from being rolled up. When the depth of the first UV-curable resin penetrating into the bottom surface 62*b* is 100 μm or less, abrasion of the tip ridgeline portion 62*c* of the elastic body blade 622 can be prevented.

A method for impregnating with the first UV-curable resin is not particularly limited, and examples thereof include dip coating.

The first UV-curable resin can be cured by applying ultraviolet rays.

The elastic body blade 622 contains a surface layer 623 containing a cured second UV-curable resin at the edge surface 62*a* thereof. As a result of this, occurrences of cleaning failures can be prevented in the normal temperature environment, as well as improving abrasion resistance.

A thickness of the surface layer 623 is typically 1 μm to 2 μm. As the thickness of the surface layer 623 is 1 μm or greater, the tip ridgeline portion 62*c* of the elastic body blade 622 can be prevented from rolled up. As the thickness of the surface layer 623 is 2 μm or less, moreover, abrasion of the tip ridgeline portion 62*c* of the elastic body blade 622 can be prevented.

The surface layer 623 can be formed by applying the second UV-curable resin to the edge surface 62*a* of the elastic body blade 622, followed by irradiating the second UV-curable resin with ultraviolet rays.

A method for coating the second UV-curable resin is not particularly limited, and examples thereof include spray coating.

Note that, the timing for coating the second UV-curable resin may be before or after curing the first UV-curable resin, as long as it is after impregnating the elastic body blade 622 with the first UV-curable resin, and drying with air for the predetermined period.

The first UV-curable resin and/or the second UV-curable resin preferably contains a first acrylic monomer, which has a functional group equivalent weight of 350 or less, is trifunctional to hexafunctional, and has a residue derived from pentaerythritol, and a second acrylic monomer, which has a functional group equivalent weight of 100 to 1,000, and is monofunctional to bifunctional. As a result of this, occurrences of cleaning failures can be further prevented in the low temperature environment. In addition, generation of noise can be prevented.

The first acrylic monomer is not particularly limited, and examples thereof include pentaerythritol triacrylate, pentaerythritol tetraacrylate, dipentaerythritol hexaacrylate, and ε-caprolactone-modified pentaerythritol triacrylate.

The second acrylic monomer is not particularly limited, and examples thereof include octyl acrylate, decyl acrylate, isobornyl acrylate, polyethylene glycol diacrylate, 1,6-hexanediol diacrylate, and urethane diacrylate.

Note that, the functional group equivalent weight means a ratio of a molecular weight to a number of polymerizable functional groups.

The first UV-curable resin and/or the second UV-curable resin preferably contains a bifunctional or higher fluorine-based acrylic monomer having a perfluoropolyether skeleton. Use of such acrylic monomer in the first or second UV-curable resin can reduce frictions between the elastic body blade 622 and the photoconductor 3.

Examples of a commercial product of the fluorine-based acrylic monomer include OPTOOL DAC-HP (product of DAIKIN INDUSTRIES, LTD.), and RS-75 (product of DIC Corporation).

The first UV-curable resin and the second UV-curable resin are preferably the same. Use of the same resin as the first UV-curable resin and the second UV-curable resin can prevent a pealing of the surface layer 623.

The elastic body blade 622 has a laminate structure containing the surface layer 623 containing the cured second UV-curable resin, a mixed layer containing the elastic body and the cured first UV-curable resin, and an elastic layer containing the elastic body. Moreover, the cured first UV-curable resin and the cured second UV-curable resin are detected in the area adjacent to the tip ridgeline portion 62*c* of the elastic body blade 622. The cured first UV-curable resin is present with a concentration gradient, where the detection intensity decreases from the surface side to the inner side. Specifically, an interface between the mixed layer and the elastic layer is not clear in the elastic body blade 622. In the case where the first UV-curable resin and the second UV-curable resin are the same, moreover, an interface between the surface layer 623 and the mixed layer may not be clear in the elastic body blade 622, because of an influence of swelling of the second UV-curable resin to the elastic body when the surface layer 623 is formed. In this manner, the elastic body blade 622 has the laminate structure, in which interfaces between the surface layer 623, the mixed layer, and the elastic layer are not clear.

Meanwhile, both the mixed layer and the surface layer 623 change the elasticity of the elastic body. When the elasticity of the elastic body is largely changed, close contact of the elastic body blade to the surface of the photoconductor 3 may be lost. As a result, cleaning failures may occur in the low temperature environment with which the cleaning performance tends to be deteriorate. As the elasticity of the elastic body blade 622 is largely changed to lose close contact with the photoconductor 3, specifically, the contact pressure of the elastic body blade 622 along the longitudinal direction to be in contact with the surface of the photoconductor 3 is changed, when the photoconductor 3 is eccentric, or there are fine waviness on the surface of the photoconductor 3. As a result, the correspondence of the tip ridgeline portion 62*c* of the elastic body blade 622 to the surface of the photoconductor 3 is impaired. Therefore, the toner passes through the elastic body blade 622, to thereby cause a cleaning failure.

Particularly in the image forming apparatus containing a lubricant coating system, the lubricant applied on the photoconductor 3 is deteriorated by charging performed by a charging device composed of a charging roller, to increase viscosity thereof. As a result, the correspondence of the tip ridgeline portion 62*c* of the elastic body blade 622 to the surface of the photoconductor 3 may be impaired, to thereby cause a cleaning failure.

As described above, a cleaning failure is caused in association with a toner. Therefore, the Martens hardness of the surface layer 623 is measured integrally with resin particles assuming a size of the toner, and a range thereof is defined.

Specifically, a load-displacement curve of the Martens hardness of the elastic body blade has inflection points, where the load-displacement curve is obtained by pressing a region of the surface layer 623 of the elastic body blade 622 via resin particles having the average particle diameter of 5 μm to 10 μm, and a distance of the region of the surface layer from the tip ridgeline portion 62*c* is 0.5 mm or less. When the load-displacement curve of the Martens hardness has one inflection point, abrasion resistance is low, and cleaning failures occur in the normal temperature environment, and the low temperature environment.

When a ratio of a displacement at the inflection point, with which a load is maximum, to the average particle diameter of the resin particles is less than 1.5, or greater than 2.0, cleaning failures occur in the low temperature environment.

Note that, the average particle diameter of the resin particles can be measured by means of a laser microscope VK-9500 (manufactured by KEYENCE CORPORATION). Specifically, the resin particles are scattered on a smooth glass substrate in a manner that each particle is separated, and shapes of the particles are measured, followed by calculating the average particle diameter based on the data of the particle diameters.

The resin particles are not particularly limited, provided that they are not deformed when the Martens hardness thereof is measured. Examples thereof include acrylic resin particles, polyether sulfone resin particles, and benzoguanamine resin particles.

As for the acrylic resin particles, cross-linked PMMA particles can be used.

The resin particles are typically in the shapes of spheres, and are harder than the surface layer 623.

It is considered that a profile of the load-displacement curve of the Martens hardness is largely related to a state where the toner is held by the elastic body blade 622. The profile thereof can be controlled by a material constituting the elastic body blade 622, impregnation of the elastic body blade 622 with the first UV-curable resin, and formation of the surface layer 623 with the second UV-curable resin.

Figure 7:
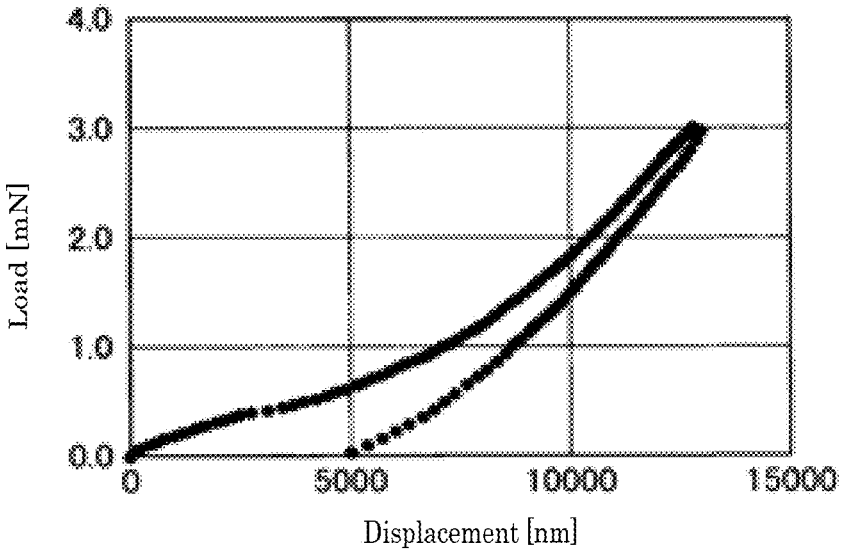
FIG. 7 is a diagram depicting one example of a load-displacement curve of the Martens hardness, having a plurality of inflection points.
Figure 8:
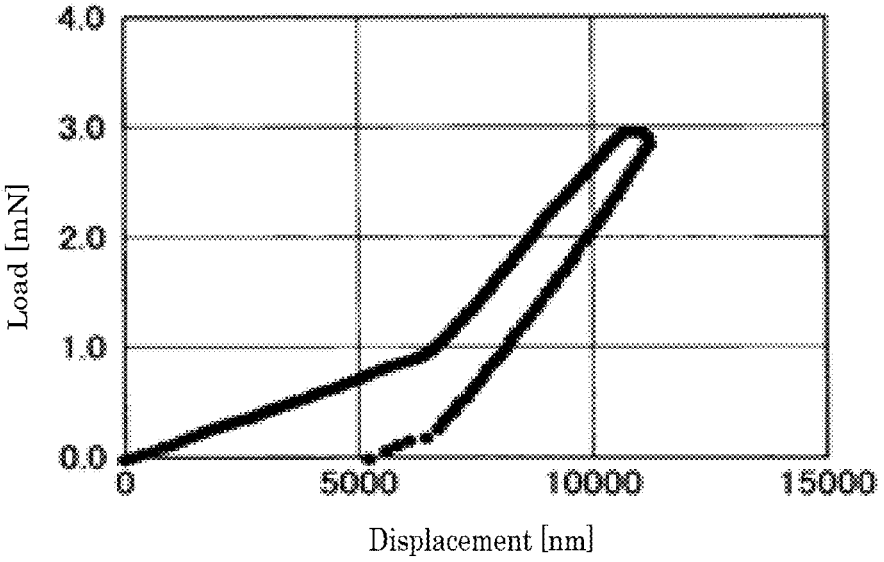
FIG. 8 is a diagram depicting one example of a load-displacement curve of the Martens hardness, having one inflection point.

Typically, a load-displacement curve of the Martens hardness of an elastic body blade, which is hard as a whole, has a plurality of inflection points (see FIG. 7), and a load-displacement curve of the Martens hardness of an elastic body blade, which is soft as a whole, has one inflection point (see FIG. 8). Since the surface layer functions to prevent local deformation due to penetration of the resin particles in the elastic body blade, in which the hard surface layer is present, a ratio of the displacement of the inflection point at which the load is maximum, to the particle diameters of the resin particles tend to increase.

In the low temperature environment, with which cleaning performance tend to deteriorate, an appropriate degree of deformation of the elastic body blade 622 is necessary to effectively hold a toner with the elastic body blade 622 without passing the toner through. When the elastic body blade 622 too soft, i.e., the ratio of the displacement of the inflection point, at which the load is maximum, to the average particle diameter of the resin particles is less than 1.5, the toner may enter to the downstream side relative to the traveling direction of the surface of the photoconductor 3 from the tip ridgeline portion 62*c*, as the tip ridgeline portion 62*c* is deformed. In addition, a deposition or adhesion of the toner components may occur, as the toner is pressed onto the photoconductor 3. When the elastic body blade 622 is too hard, i.e., the ratio of the displacement of the inflection point, at which the load is maximum, to the average particle diameter of the resin particles is greater than 2.0, a small gap may be formed due to insufficient contact of the tip ridgeline portion 62*c* to the photoconductor 3, the external additives fled from the toner may be passed through the gap continuously, to locally wear the elastic body blade, and the toner may be passed through the worn elastic body blade.

Next, the toner is explained.

The toner typically contains base particles, and external additives.

A production method of the base particles is preferably a suspension polymerization method, an emulsion polymerization method, or a dispersion polymerization method, because these production methods can yield particles of high average circularity and small particle diameters. Specifically, the toner is preferably a polymerization toner. Use of the polymerization toner can improve an image quality.

The polymerization toner preferably has the average circularity of 0.97 or greater, as well as having the volume average particle diameter of 5.5 μm or smaller. Use of such the polymerization toner can form a high resolution image.

Note that, the average circularity of the polymerization toner can be measured by means of a flow particle image analyzer FPIA-2000 (manufactured by Sysmex Corporation).

Moreover, the volume average particle diameter of the polymerization toner can be measured by a Coulter Counter method.

When removal of the polymerization toner is attempted from a surface of the photoconductor 3 using the elastic body blade 622 in the same manner as the removal of the pulverization toner, the residual toner cannot be sufficiently removed, and cleaning failures may occur. If the contact pressure of the elastic body blade 622 is increased in order to solve the aforementioned problem, the elastic body blade 622 tends to be worn. Moreover, the frictions between the elastic body blade 622 and the photoconductor 3 are increased, and hence the tip ridgeline portion 62*c* of the elastic body blade 622, which is in contact with the photoconductor 3, is pulled along the traveling direction of the photoconductor 3 to roll the tip ridgeline portion 62*c* up. When the tip ridgeline portion 62*c* of the elastic body blade 622 is rolled up, noise is generated.

EXAMPLES

Examples of the present invention are explained hereinafter, but these examples shall not be construed as to limit the scope of the present invention in any way. In the following examples, "part(s)" denotes "part(s) by mass," unless otherwise stated.

(Preparation of UV-Curable Resin Composition 1)

UV-Curable Resin Composition 1 was obtained by blending 8 parts of pentaerythritol (tri/tetra)acrylate PETIA (product of DAICEL-ALLNEX LTD.) having the functional group equivalent weight of 88 to 99, 2 parts of (octyl/decyl)acrylate ODA-N (product of DAICEL-ALLNEX LTD.) having the functional group equivalent weight of 200, 0.1 parts of a bifunctional acrylic monomer having a perfluoropolyether skeleton OPTOOL DAC-HP (product of DAIKIN INDUSTRIES, LTD.), and 0.5 parts of a polymerization initiator IRGACURE 184 (product of BASF Japan Ltd.), and 89.4 parts of cyclohexanone.

(Preparation of UV-Curable Resin Composition 2)

UV-Curable Resin Composition 2 was obtained by blending 7 parts of pentaerythritol (tri/tetra)acrylate PETIA (product of DAICEL-ALLNEX LTD) having the functional group equivalent weight of 88 to 99, 3 parts of 1,6-hexanediol diacrylate HDDA (product of DAICEL-ALLNEX LTD.) having the functional group equivalent weight of 113, 0.5 parts of a polymerization initiator IRGACURE 184 (product of BASF Japan Ltd.), and 89.5 parts of cyclohexanone.

(Preparation of UV-Curable Resin Composition 3)

UV-Curable Resin Composition 3 was obtained by blending 10 parts of pentaerythritol (tri/tetra)acrylate PETIA (product of DAICEL-ALLNEX LTD.) having the functional group equivalent weight of 88 to 99, 0.1 parts of a bifunctional acrylic monomer having a perfluoropolyether skeleton OPTOOL DAC-HP (product of DAIKIN INDUSTRIES, LTD.), 0.5 parts of a polymerization initiator IRGACURE 184 (product of BASF Japan Ltd.), and 89.4 parts of cyclohexanone.

(Preparation of UV-Curable Resin Composition 4)

UV-Curable Resin Composition 4 was obtained by blending 8 parts of pentaerythritol (tri/tetra)acrylate PETIA (product of DAICEL-ALLNEX LTD.) having the functional group equivalent weight of 88 to 99, 2 parts of isobornyl acrylate IBOA-B (product of DAICEL-ALLNEX LTD.) having the functional group equivalent weight of 198, 0.1 parts of a bifunctional acrylic monomer having a perfluoropolyether skeleton OPTOOL DAC-HP (product of DAIKIN INDUSTRIES, LTD.), 0.5 parts of a polymerization initiator IRGACURE 184 (product of BASF Japan Ltd.), and 89.4 parts of cyclohexanone.

(Preparation of UV-Curable Resin Composition 5)

UV-Curable Resin Composition 5 was obtained by blending 7 parts of pentaerythritol (tri/tetra)acrylate PETIA (product of DAICEL-ALLNEX LTD.) having the functional group equivalent weight of 88 to 99, 3 parts of PEG600 diacrylate EBECRYL11 (product of DAICEL-ALLNEX LTD.) having the functional group equivalent weight of 263, 0.1 parts of a bifunctional acrylic monomer having a perfluoropolyether skeleton OPTOOL DAC-HP (product of DAIKIN INDUSTRIES, LTD.), 0.5 parts of a polymerization initiator IRGACURE 184 (product of BASF Japan Ltd.), and 89.4 parts of cyclohexanone.

(Preparation of UV-Curable Resin Composition 6)

UV-Curable Resin Composition 6 was obtained by blending 10 parts of dipentaerythritol hexaacrylate DPHA (product of DAICEL-ALLNEX LTD.) having the functional group equivalent weight of 96, 1 part of a polymerization initiator IRGACURE 184 (product of BASF Japan Ltd.), 89 parts of cyclohexanone.

(Preparation of UV-Curable Resin Composition 7)

UV-Curable Resin Composition 7 was obtained by blending 8 parts of ϵ-caprolactone-modified pentaerythritol hexacrylate DPCA-120 (product of Nippon Kayaku Co., Ltd.) having the functional group equivalent weight of 325, 2 parts of isobornyl acrylate IBOA-B (product of DAICEL-ALLNEX LTD.) having the functional group equivalent weight of 198, 0.1 parts of a bifunctional acrylic monomer having a perfluoropolyether skeleton RS-75 (product of DIC Corporation), 0.5 parts of a polymerization initiator IRGACURE 184 (product of BASF Japan Ltd.), and 89.4 parts of cyclohexanone.

(Preparation of UV-Curable Resin Composition 8)

UV-Curable Resin Composition 8 was obtained by blending 5 parts of pentaerythritol (tri/tetra)acrylate PETIA (product of DAICEL-ALLNEX LTD.) having the functional group equivalent weight of 88 to 99, 5 parts of urethane diacrylate UN2700 (product of Negami Chemical Industrial Co., Ltd.), 0.1 parts of a bifunctional acrylic monomer having a perfluoropolyether skeleton RS-75 (product of DIC Corporation), 0.5 parts of a polymerization initiator IRGACURE 184 (product of BASF Japan Ltd.), and 89.4 parts of cyclohexanone.

Example 1

A rectangular elastic body base material was produced using urethane rubber having hardness of 75 degrees at 25° C., rebound resistance of 45% at 25° C., and a thickness of 1.8 mm (manufactured by Toyo Tire & Rubber Co., Ltd.) (referred to as Urethane Rubber 4, hereinafter). Subsequently, a region of the elastic body base material, a distance of which from the edge surface of the elastic body base material was 1.8 mm, was impregnated with UV-Curable Resin Composition 2 through dip coating, followed by drying UV-Curable Resin Composition 2 with air for 3 minutes. In addition, UV-Curable Resin Composition 2 was applied to the edge surface of the elastic body base material through spray coating at the spray gun travelling speed of 10 mm/s, followed by drying to the touch for 3 minutes. During the application of UV-Curable Resin Composition 2, the surfaces other than the edge surface of the elastic body base material were covered with masking tape. Subsequently, ultraviolet rays of 2,000 mJ/cm$^2$ were applied to the elastic body base material with 3 passes, to cure UV-Curable Resin Composition 2, to thereby obtain an elastic body blade.

A depth of the elastic body blade impregnated with the UV-curable resin composition was 100 μm, a depth of the UV-curable resin composition penetrating into the surface (referred to as a "bottom surface" hereinafter) extending from the edge of the tip ridgeline portion in the direction towards the fixed end of the elastic blade was 80 μm, and a thickness of the surface layer was 1.5 μm. Moreover, the load-displacement curve of the Martens hardness obtained by pressing via the resin particles having the average particle diameter of 5 μm had a plurality of inflection points, and a ratio of the displacement of the inflection point, at which the load was maximum, to the average particle diameter of the resin particles was 1.9.

Example 2

An elastic body blade was obtained in the same manner as in Example 1, provided that Urethane Rubber 4 and UV-Curable Resin Composition 2 were replaced with urethane rubber whose hardness at 25° C. was 69 degrees, rebound resilience at 25° C. was 50%, and thickness was 1.8 mm (manufactured by Toyo Tire & Rubber Co., Ltd.) (referred to as Urethane Rubber 2, hereinafter), and UV-Curable Resin Composition 4, respectively.

A depth of the elastic body blade impregnated with the UV-curable resin composition was 120 μm, a depth of the UV-curable resin composition penetrating into the bottom surface was 100 μm, and a thickness of the surface layer was 1.8 μm. Moreover, the load-displacement curve of the Martens hardness obtained by pressing via the resin particles having the average particle diameter of 10 μm had a plurality of inflection points, and a ratio of the displacement of the inflection point, at which the load was maximum, to the average particle diameter of the resin particles was 1.5.

Example 3

An elastic body blade was obtained in the same manner as in Example 1, provided that Urethane Rubber 4 and UV-Curable Resin Composition 2 were replaced with urethane rubber having hardness of 72 degrees at 25° C., rebound resilience of 31% at 25° C., and a thickness of 1.8 mm (manufactured by Toyo Tire & Rubber Co., Ltd.) (referred to as Urethane Rubber 1, hereinafter) and UV-Curable Resin Composition 5, respectively.

A depth of the elastic body blade impregnated with the UV-curable resin composition was 80 μm, a depth of the UV-curable resin composition penetrating into the bottom surface was 60 μm, and a thickness of the surface layer was 1.6 μm. Moreover, the load-displacement curve of the Martens hardness obtained by pressing via the resin particles having the average particle diameter of 5 μm had a plurality of inflection points, and a ratio of the displacement of the inflection point, at which the load was maximum, to the average particle diameter of the resin particles was 2.0.

Example 4

An elastic body blade was obtained in the same manner as in Example 1, provided that Urethane Rubber 4 and UV-Curable Resin Composition 2 were replaced with urethane rubber (product of BANDO CHEMICAL INDUSTRIES, LTD.) (referred to as Urethane Rubber 6, hereinafter) each layer of which had a thickness of 1.8 mm, and UV-Curable Resin Composition 6, respectively. Urethane Rubber 6 was a laminate of two different types of urethane rubber, and the side of Urethane Rubber 6 to be in contact with a photoconductor had the hardness of 66 degrees at 25° C., the side thereof not to be in contact with a photoconductor had the hardness of 75 degrees at 25° C., and rebound resilience thereof was 30% at 25° C.

A depth of the elastic body blade impregnated with the UV-curable resin composition was 150 μm, a depth of the UV-curable resin composition penetrating into the bottom surface was 100 μm, and a thickness of the surface layer was 1.0 μm. Moreover, the load-displacement curve of the Martens hardness obtained by pressing via the resin particles having the average particle diameter of 5 μm had a plurality of inflection points, and a ratio of the displacement of the inflection point, at which the load was maximum, to the average particle diameter of the resin particles was 1.6.

Example 5

An elastic body blade was obtained in the same manner as in Example 1, provided that Urethane Rubber 4 and UV-Curable Resin Composition 2 were replaced with urethane rubber having hardness of 68 degrees at 25° C., rebound resilience of 30% at 25° C., and a thickness of 1.8 mm (manufactured by Toyo Tire & Rubber Co., Ltd.) (referred to as Urethane Rubber 3, hereinafter) and UV-Curable Resin Composition 1, respectively.

A depth of the elastic body blade impregnated with the UV-curable resin composition was 50 μm, a depth of the UV-curable resin composition penetrating into the bottom surface was 20 μm, and a thickness of the surface layer was 1.5 μm. Moreover, the load-displacement curve of the Martens hardness obtained by pressing via the resin particles having the average particle diameter of 10 μm had a plurality of inflection points, and a ratio of the displacement of the inflection point, at which the load was maximum, to the average particle diameter of the resin particles was 1.8.

Example 6

A rectangular elastic body base material was produced using urethane rubber (manufactured by Toyo Tire & Rubber Co., Ltd.) (referred to as Urethane Rubber 5, hereinafter) having a thickness of 1.8 mm. Urethane Rubber 5 was a laminate of two different types of urethane rubber, where the hardness thereof at the side to be in contact with photoconductor was 80 degrees at 25° C., the hardness thereof at the side not to be in contact with the photoconductor was 75 degrees at 25° C., and the rebound resilience at 25° C. was 25%.

Subsequently, a region of the elastic body base material, a distance of which from the edge surface of the elastic body base material was 1.8 mm, was impregnated with UV-Curable Resin Composition 3 through dip coating, followed by drying UV-Curable Resin Composition 3 with air for 3 minutes. In addition, UV-Curable Resin Composition 5 was applied to the edge surface of the elastic body base material through spray coating at the spray gun travelling speed of 10 mm/s, followed by drying to the touch for 3 minutes. During the application of UV-Curable Resin Composition 5, the surfaces other than the edge surface of the elastic body base material were covered with masking tape. Subsequently, ultraviolet rays of 2,000 mJ/cm$^2$ were applied to the elastic body base material with 3 passes, to cure UV-Curable Resin Composition 3 and UV-curable Resin Composition 5, to thereby obtain an elastic body blade.

A depth of the elastic body blade impregnated with the UV-curable resin composition was 100 μm, a depth of the UV-curable resin composition penetrating into the bottom surface was 70 μm, and a thickness of the surface layer was 1.7 μm. Moreover, the load-displacement curve of the Martens hardness obtained by pressing via the resin particles having the average particle diameter of 5 μm had a plurality of inflection points, and a ratio of the displacement of the inflection point, at which the load was maximum, to the average particle diameter of the resin particles was 2.0.

Example 7

An elastic body blade was obtained in the same manner as in Example 1, provided that Urethane Rubber 4 and UV-Curable Resin Composition 2 were replaced with Urethane Rubber 1 and UV-Curable Resin Composition 7, respectively.

A depth of the elastic body blade impregnated with the UV-curable resin composition was 70 μm, a depth of the UV-curable resin composition penetrating into the bottom surface was 50 μm, and a thickness of the surface layer was 1.4 μm. Moreover, the load-displacement curve of the Martens hardness obtained by pressing via the resin particles having the average particle diameter of 5 μm had a plurality of inflection points, and a ratio of the displacement of the inflection point, at which the load was maximum, to the average particle diameter of the resin particles was 1.8.

Example 8

An elastic body blade was obtained in the same manner as in Example 1, provided that UV-Curable Resin Composition 2 was replaced with UV-Curable Resin Composition 8.

A depth of the elastic body blade impregnated with the UV-curable resin composition was 140 μm, a depth of the UV-curable resin composition penetrating into the bottom surface was 100 μm, and a thickness of the surface layer was 1.0 μm. Moreover, the load-displacement curve of the Martens hardness obtained by pressing via the resin particles having the average particle diameter of 5 μm had a plurality of inflection points, and a ratio of the displacement of the inflection point, at which the load was maximum, to the average particle diameter of the resin particles was 1.6.

Example 9

An elastic body blade was obtained in the same manner as in Example 6, provided that Urethane Rubber 5, UV-Curable Resin Composition 3, and UV-Curable Resin Composition 5 were replaced with Urethane Rubber 2, UV-Curable Resin Composition 2, and UV-Curable Resin Composition 4, respectively.

A depth of the elastic body blade impregnated with the UV-curable resin composition was 130 μm, a depth of the UV-curable resin composition penetrating into the bottom surface was 90 μm, and a thickness of the surface layer was 1.2 μm. Moreover, the load-displacement curve of the Martens hardness obtained by pressing via the resin particles having the average particle diameter of 5 μm had a plurality of inflection points, and a ratio of the displacement of the inflection point, at which the load was maximum, to the average particle diameter of the resin particles was 1.7.

Example 10

An elastic body blade was obtained in the same manner as in Example 1, provided that Urethane Rubber 4 and UV-Curable Resin Composition 2 were replaced with Urethane Rubber 3 and UV-Curable Resin Composition 1, respectively.

A depth of the elastic body blade impregnated with the UV-curable resin composition was 90 μm, a depth of the UV-curable resin composition penetrating into the bottom surface was 70 μm, and a thickness of the surface layer was 2.0 μm. Moreover, the load-displacement curve of the Martens hardness obtained by pressing via the resin particles having the average particle diameter of 5 μm had a plurality of inflection points, and a ratio of the displacement of the inflection point, at which the load was maximum, to the average particle diameter of the resin particles was 1.6.

Comparative Example 1

A rectangular elastic body base material was produced using Urethane Rubber 2. Subsequently, UV-Curable Resin Composition 2 was applied to the edge surface of the elastic body base material through spray coating at the spray gun travelling speed of 10 mm/s, followed by applying UV-Curable Resin Composition 2 to a region on the bottom surface of the elastic body base material, a distance of which from the edge surface was 5 mm, through spray coating in the same manner. During the application of UV-Curable Resin Composition 2, the surfaces other than each coating surface of the elastic body base material were covered with masking tape. After drying the applied UV-curable resin composition to the touch for 3 minutes, ultraviolet rays of 2,000 mJ/cm$^2$ were applied to the elastic body base material with 3 passes, to cure UV-Curable Resin Composition 2, to thereby obtain an elastic body blade.

A depth of the elastic body blade impregnated with the UV-curable resin composition was 0 μm, a thickness of the surface layer provided at the edge surface was 3.0 μm, and a thickness of the surface layer at the bottom surface was 5.0 μm. Moreover, the load-displacement curve of the Martens hardness obtained by pressing via the resin particles having the average particle diameter of 5 μm had a plurality of inflection points, and a ratio of the displacement of the inflection point, at which the load was maximum, to the average particle diameter of the resin particles was 2.1.

Comparative Example 2

An elastic body blade was obtained in the same manner as in Example 6, provided that UV-Curable Resin Composition 2 was used instead of UV-Curable Resin Composition 3, and UV-Curable Resin Composition 5 was not used.

A depth of the elastic body blade impregnated with the UV-curable resin composition was 130 μm, a depth of the UV-curable resin composition penetrating into the bottom surface was 100 μm, and a thickness of the surface layer was 0 μm. Moreover, the load-displacement curve of the Martens hardness obtained by pressing via the resin particles having the average particle diameter of 5 μm had one inflection point, and a ratio of the displacement of the inflection point, at which the load was maximum, to the average particle diameter of the resin particles was 1.0.

Comparative Example 3

A rectangular elastic body blade was produced using Urethane Rubber 1.

The load-displacement curve of the Martens hardness obtained by pressing via the resin particles having the average particle diameter of 5 μm had one inflection point, and a ratio of the displacement of the inflection point, at which the load was maximum, to the average particle diameter of the resin particles was 1.0.

Comparative Example 4

A rectangular elastic body base material was produced using Urethane Rubber 1. Subsequently, a region of the elastic body base material, a distance of which from the edge surface of the elastic body base material was 1.8 mm, was impregnated with UV-Curable Resin Composition 7 through dip coating, followed by drying UV-Curable Resin Composition 7 with air for 3 minutes. In addition, UV-Curable Resin Composition 7 was applied to the edge surface of the elastic body base material through spray coating at the spray gun travelling speed of 10 mm/s, followed by applying UV-Curable Resin Composition 7 to a region of the bottom surface of the elastic body base material, a distance of which from the edge surface was 5 mm through spray coating in the same manner. During the application of UV-Curable Resin Composition 7, the surfaces other than each coating surface of the elastic body base material were covered with masking tape. After drying the applied UV-curable resin composition to the touch for 3 minutes, ultraviolet rays of 2,000 mJ/cm$^2$ were applied to the elastic body base material with 3 passes, to cure UV-Curable Resin Composition 7, to thereby obtain an elastic body blade.

A depth of the elastic body blade impregnated with the UV-curable resin composition was 100 μm, a depth of the UV-curable resin composition penetrating into the bottom surface was 80 μm, and a thickness of the surface layer provided at the edge surface was 1.0 μm, and a thickness of the surface layer provided at the bottom surface was 1.0 μm. Moreover, the load-displacement curve of the Martens hardness obtained by pressing via the resin particles having the average particle diameter of 5 μm had a plurality of inflection points, and a ratio of the displacement of the inflection point, at which the load was maximum, to the average particle diameter of the resin particles was 2.2.

(Hardness of Urethane Rubber)

The hardness of the urethane rubber was measured by means of a micro-rubber hardness tester MD-1 (manufactured by KOBUNSHI KEIKI CO., LTD.) in accordance with JIS K6253. As for the measurement of the urethane rubber, in which two different types of urethane rubber were laminated, the hardness of each urethane rubber was measured at the side thereof to be in contact with a photoconductor, and at the side thereof not to be in contact with a photoconductor.

(Rebound Resilience of Urethane Rubber)

The rebound resilience of the urethane rubber was measured by means of No. 221 resilience tester (manufactured by TOYO SEIKI SEISAKU-SHO, LTD.) in accordance with JIS K6255. The measurement of the rebound resilience was performed on a laminate where three sheets of the urethane rubber each having a thickness of 1.8 mm were laminated.

(Thickness of Surface Layer)

An elastic body blade, which had been separately produced in the same manner, was cut by means of a trimming cutter for producing SEM samples (manufactured by Nisshin EM Corporation). The cut surface of the elastic body blade was observed under a microscope VHX-100 (manufactured by KEYENCE CORPORATION), to determine a thickness of the surface layer.

(Depth of Impregnating UV-Curable Resin Composition)

An elastic body blade, which had been separately produced in the same manner, was cut by means of CryoMicrotome (EM•FCS, product of Leica), to thereby obtain a thin cross-sectional cut piece. The thin cross-sectional cut piece was observed by IR microscopic system Nicolet Continuum (manufactured by Hitachi High-Technologies Corporation), to determine a depth of the UV-curable resin composition impregnating. As for the measurement, as illustrated in FIG. 5, each depth was determined based on the edge surface **62*a* of the elastic body blade 622 (e.g., an interface between the elastic body blade 622 and the surface layer 623), and the surface (bottom surface) extending from the tip ridgeline portion 62***c* of the elastic body blade 622 in the direction towards the fixed end of the elastic blade. The depth was determined from the position at which an index is about 1.0. As for the index, a standardized value of a ratio of an area of a peak adjacent to the wavelength of 1,710 $cm^{-1}$ relative to an area of a peak at a wavelength of 1,415 $cm^{-1}$, using a value of the elastic body base material, which had not been impregnated with a UV-curable resin composition.

(Load-Displacement Curve of the Martens Hardness)

A region of a surface layer of an elastic body blade, which had been separately produced in the same manner, was provided as a measuring sample. A distance of the region from the tip ridgeline portion of the elastic blade was 0.5 mm or less. Subsequently, the measuring sample was pressed via resin particles, by means of a nano indenter G200 (manufactured by MTS Systems Corporation). As for the pressing, a flat indenter in the shape of a square having each side of 20 μm was attached to the nano indenter G200 (manufactured by MTS Systems Corporation). As for the resin particles, moreover, acrylic resin particles TAFTIC FH-S (manufactured by TOYOBO CO., LTD.) having the average particle diameter of 5 μm or 10 μm.

(Production of Image Forming Apparatus)

To a metal plate holder that could be mounted in a color multifunction peripheral imagio MP C5000 (manufactured by Ricoh Company Limited), the elastic body blade was fixed with an adhesive, to thereby obtain a cleaning blade. The cleaning blade was mounted in the color multifunction peripheral imagio MP C5000 (manufactured by Ricoh Company Limited), to thereby obtain an image forming apparatus. Note that, the cleaning blade was attached by setting a linear load, and a cleaning angle, with the predetermined edge penetration quantity, and an attaching angle.

As for a toner, a toner produced by a polymerization method was used. The toner was composed of base particles, and external additives, had the average circularity of 0.98, and had the volume average particle diameter of 4.9 μm. As for the external additives, 1.5 parts of silica particles H1303 (manufactured by Clariant Japan K.K.), 0.5 parts of titanium oxide particles MT-150AI (manufactured by TAYCA CORPORATION), and 1.0 part of silica particles UFP-35HH (manufactured by DENKI KAGAKU KOGYO KABUSHIKI KAISHA) were used.

<Average Circularity of Toner>

To 100 mL to 150 mL of water in a container, from which impurity solids had been removed in advance, 0.1 mL to 0.5 mL of an alkyl benzene sulfonate surfactant was added. Thereafter, about 0.1 g to about 0.5 g of the toner was added. Subsequently, the mixture was dispersed for about 1 minute to about 3 minutes by means of an ultrasonic disperser, followed by adjusting a concentration of the toner to the range of 3,000 particle/μL to 10,000 particle/μL. Moreover, a flow particle image analyzer FPIA-2000 (manufactured by Sysmex Corporation), to measure the average circularity of the toner.

<Volume Average Particle Diameter of Toner>

A number distribution and volume distribution of the toner measured by Coulter Miltisizer 2e (manufactured by Beckman Coulter, Inc.) were sent to a personal computer via an interface (available from Nikkaki Bios Co., Ltd.) to thereby perform an analysis.

After adding 0.1 mL to 5 mL of a surfactant (alkyl benzene sulfonate) to 100 mL to 150 mL of a 1% by mass NaCl aqueous solution, 2 mg to 20 mg of the toner was added. Subsequently, the mixture was dispersed for about 1 minute to about 3 minutes by means of an ultrasonic disperser, to thereby obtain a dispersion liquid of the toner. The dispersion liquid of the toner was added to 100 mL to 200 mL of a 1% by mass NaCl aqueous solution to have the predetermined concentration. Subsequently, the resultant was set in the Coulter Miltisizer 2e, to thereby measure the volume average particle diameter of the toner. During the measurement, an aperture of 100 μm was used, and particles diameters of 50,000 toner particles were measured. As for channels, the following 13 channels were used: 2.00 μm or larger, but smaller than 2.52 μm; 2.52 μm or larger, but smaller than 3.17 μm; 3.17 μm or larger, but smaller than 4.00 μm; 4.00 μm or larger, but smaller than 5.04 μm; 5.04 μm or larger, but smaller than 6.35 μm; 6.35 μm or larger, but smaller than 8.00 μm; 8.00 μm or larger, but smaller than 10.08 μm; 10.08 μm or larger, but smaller than 12.70 μm; 12.70 μm or larger, but smaller than 16.00 μm; 16.00 μm or larger, but smaller than 20.20 μm; 20.20 μm or larger, but smaller than 25.40 μm; 25.40 μm or larger, but smaller than 32.00 μm; and 32.00 μm or larger, but smaller than 40.30 μm. The target particles for the measurement were particles having the diameters of 2.00 μm or larger, but smaller than 40.30 μm The properties of the cleaning blades are presented in Tables 1-1 and 1-2.

TABLE 1-1

| | Urethane rubber | UV-curable resin composition for impregnation | UV-curable resin composition for surface layer | Depth of impregnation on edge surface [μm] | Depth of impregnation on bottom surface [μm] |
|---|---|---|---|---|---|
| Ex. 1 | 4 | 2 | 2 | 100 | 80 |
| Ex. 2 | 2 | 4 | 4 | 120 | 100 |
| Ex. 3 | 1 | 5 | 5 | 80 | 60 |
| Ex. 4 | 6 | 6 | 6 | 150 | 100 |
| Ex. 5 | 3 | 1 | 1 | 50 | 20 |
| Ex. 6 | 5 | 3 | 5 | 100 | 70 |
| Ex. 7 | 1 | 7 | 7 | 70 | 50 |
| Ex. 8 | 4 | 8 | 8 | 140 | 100 |
| Ex. 9 | 2 | 2 | 4 | 130 | 90 |
| Ex. 10 | 3 | 1 | 1 | 90 | 70 |
| Comp. Ex. 1 | 2 | — | 2 | — | — |
| Comp. Ex. 2 | 5 | 2 | — | 130 | 100 |
| Comp. Ex. 3 | 1 | — | — | — | — |
| Comp. Ex. 4 | 1 | 7 | 7 | 100 | 80 |

TABLE 1-2

| | Thickness of surface layer at edge surface [μm] | Thickness of surface layer at bottom surface [μm] | Number of inflection points | Deviation of inflection at max load/average particle diameter of resin particles |
|---|---|---|---|---|
| Ex. 1 | 1.5 | 0.0 | | 1.9 |
| Ex. 2 | 1.8 | 0.0 | | 1.5 |
| Ex. 3 | 1.6 | 0.0 | | 2.0 |
| Ex. 4 | 1.0 | 0.0 | | 1.6 |
| Ex. 5 | 1.5 | 0.0 | | 1.8 |
| Ex. 6 | 1.7 | 0.0 | | 2.0 |
| Ex. 7 | 1.4 | 0.0 | | 1.8 |
| Ex. 8 | 1.0 | 0.0 | | 1.6 |
| Ex. 9 | 1.2 | 0.0 | | 1.7 |
| Ex. 10 | 2.0 | 0.0 | | 1.6 |
| Comp. Ex. 1 | 3.0 | 5.0 | | 2.1 |
| Comp. Ex. 2 | 0.0 | 0.0 | 1 | 1.0 |

TABLE 1-2-continued

| | Thickness of surface layer at edge surface [μm] | Thickness of surface layer at bottom surface [μm] | Number of inflection points | Deviation of inflection at max load/ average particle diameter of resin particles |
|---|---|---|---|---|
| Comp. Ex. 31.0 | 0.0 | 0.0 | 1 | 1.0 |
| Comp. Ex. 4 | 1.0 | 1.0 | | 2.2 |

(Durability Test 1)

After printing a chart having an imaging area ratio of 5% on 100,000 sheets of landscape A4 at 3 prints/job in the normal temperature environment of 21° C., 65% RH, evaluations were performed in terms of a cleaning failure, abrasion resistance, and noise.

<Cleaning Failure>

Three charts each horizontal to the printing direction and each having a width of 43 mm were printed on 20 sheets of landscape A4, and an occurrence of a cleaning failure was visually observed.

<Abrasion Resistance>

Figure 6:
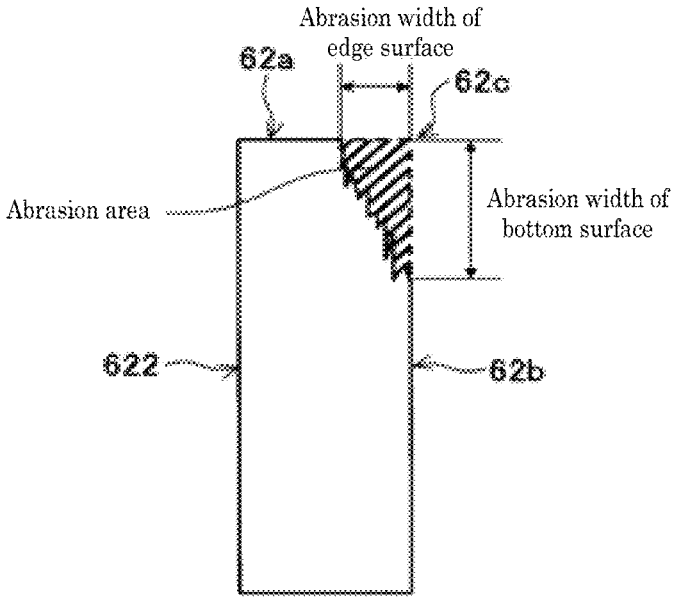
FIG. 6 is a schematic diagram illustrating an abrasion width and abrasion cross-section area of the elastic body blade.

An abrasion cross-section area and an abrasion width of the elastic body edge were measured from the upper side at an angle of 45° by means of a laser microscope VK-9500 (manufactured by KEYENCE CORPORATION) (see FIG. 6).

<Noise>

Any noise generated was aurally evaluated.

(Durability Test 2)

After completing Durability Test 1, an evaluation was performed in terms of a cleaning failure in the same manner as in Durability Test 1, provided that the evaluation was performed in the state where the conditions were adjusted to the low temperature environment of 10° C., 15% RH.

The evaluation results of the cleaning failure and abrasion resistance of the cleaning blade are presented in Table 2.

TABLE 2

| | Normal temperature environment | | | | | |
|---|---|---|---|---|---|---|
| | Abrasion area [μm$^2$] | Abrasion width on edge surface [μm] | Abrasion width on bottom surface [μm] | Cleaning failure | Noise | Low temperature environment Cleaning failure |
| Ex. 1 | 80 | 22 | 7 | None | None | None |
| Ex. 2 | 70 | 20 | 7 | None | None | None |
| Ex. 3 | 90 | 23 | 8 | None | None | None |
| Ex. 4 | 100 | 26 | 8 | None | None | None |
| Ex. 5 | 60 | 20 | 6 | None | None | None |
| Ex. 6 | 50 | 17 | 6 | None | None | None |
| Ex. 7 | 80 | 22 | 7 | None | None | None |
| Ex. 8 | 60 | 20 | 6 | None | None | None |
| Ex. 9 | 40 | 16 | 5 | None | None | None |
| Ex. 10 | 90 | 23 | 8 | None | None | None |
| Comp. Ex. 1 | 380 | 28 | 28 | 3 (lines) | None | 5 (lines) |
| Comp. Ex. 2 | 220 | 40 | 12 | 2 (lines) | None | 3 (lines) |
| Comp. Ex. 3 | 350 | 44 | 15 | 3 (bands) | None | 3 (bands) |
| Comp. Ex. 4 | 110 | 8 | 25 | None | None | 2 (bands) |

It was found from Table 2 that the cleaning blades of Examples 1 to 10 had excellent abrasion resistance, and could prevent a cleaning failure in the normal temperature environment, and in the low temperature environment.

On the other hand, the cleaning blade of Comparative Example 1 had low abrasion resistance, and caused cleaning failures in the normal temperature environment, and in the low temperature environment, as the elastic body blade was impregnated with the UV-curable resin composition, a surface layer was not formed at the bottom surface of the elastic body blade, and the ratio of the displacement of the inflection, with which the load was maximum, to the average particle diameter of the resin particles was 2.1.

The cleaning blade of Comparative Example 2 had low abrasion resistance, and caused cleaning failures in the normal temperature environment, and in the low temperature environment, as a surface layer was not formed on the elastic body blade, and the load-displacement curve of the Martens hardness had one inflection point.

The cleaning blade of Comparative Example 3 had low abrasion resistance, and caused cleaning failures in the normal temperature environment, and in the low temperature environment, as the elastic body blade was not impregnated with the UV-curable resin composition, a surface layer was not formed, and the load-displacement curve of the Martens hardness had one inflection point.

The cleaning blade of Comparative Example 4 caused cleaning failures in the low temperature environment, as a surface layer was not formed at the bottom surface of the elastic body blade, and the ratio of the displacement of the inflection, with which the load was maximum, to the average particle diameter of the resin particles was 2.2.

For example, the embodiments of the present invention are as follows.

<1> A cleaning blade, containing:

a rectangular elastic body blade, wherein the elastic body blade contains a cured first UV-curable resin at a tip ridgeline portion thereof, which is brought into contact with a surface of a member to be cleaned, where the cured first UV-curable resin is formed by impregnating the tip ridgeline portion of the elastic body blade with the first UV-curable resin, followed by curing the first UV-curable resin, and a depth of the elastic body blade impregnated with the first UV-curable resin from an edge surface thereof is 50 μm to 150 μm, wherein the elastic body blade contains a surface layer containing a cured second UV-curable resin at the edge surface thereof, wherein a load-displacement curve of a Martens hardness of the elastic body blade has inflection points, where the load-displacement curve is obtained by pressing a region of the surface layer of the elastic body blade via resin particles having an average particle diameter of 5 μm to 10 μm, and a distance of the region of the surface layer from the tip ridgeline portion is 0.5 mm or less, and wherein a ratio of a displacement at the inflection point, with which a load is maximum, to the average particle diameter of the resin particles is 1.5 to 2.0.

<2> The cleaning blade according to <1>, wherein a depth of the first UV-curable resin penetrating into a surface, which extends from an edge of the tip ridgeline portion in a direction towards a fixed end of the elastic body blade, is 20 μm to 100 μm.

<3> The cleaning blade according to <1> or <2>, wherein the surface layer has a thickness of 2 μm or less.

<4> The cleaning blade according to any one of <1> to <3>, wherein the first UV-curable resin, or the second UV-curable resin, or both contain a trifunctional to hexafunctional acrylic monomer having a functional group equivalent weight of 350 or less, and containing a residue derived from pentaerythritol, and a monofunctional to bifunctional acrylic monomer having a functional group equivalent weight of 100 to 1,000.

<5> The cleaning blade according to any one of <1> to <4>, wherein the first UV-curable resin, or the second UV-curable resin, or both contain a bifunctional or higher acrylic monomer having a perfluoropolyether skeleton.

<6> The cleaning blade according to any one of <1> to <5>, wherein the first UV-curable resin and the second UV-curable resin are identical.

<7> The cleaning blade according to any one of <1> to <6>, wherein the elastic body blade contains urethane rubber.

<8> The cleaning blade according to <7>, wherein the elastic body blade is a laminate of two different types of urethane rubber.

<9> An image forming apparatus, containing:

a photoconductor;

a charging unit configured to charge the photoconductor;

an exposing unit configured to expose the charged photoconductor to light to form an electrostatic latent image;

a developing unit configured to develop the electrostatic latent image formed on the photoconductor with a toner, to thereby form a toner image;

a transferring unit configured to transfer the toner image formed on the photoconductor to a recording medium; and a cleaning unit configured to clean the photoconductor from which the toner image has been transferred, wherein the cleaning unit is the cleaning blade according to any one of <1> to <8>.

<10> The image forming apparatus according to <9>, wherein a depth of the first UV-curable resin penetrating into a surface, which extends from an edge of the tip ridgeline portion in a direction towards a fixed end of the elastic body blade, is 20 μm to 100 μm.

<11> A process cartridge, containing:

a photoconductor; and a cleaning unit, wherein the process cartridge is detachably mounted in a main body of an image forming apparatus, wherein the cleaning unit is the cleaning blade according to any one of <1> to <8>.

<12> The process cartridge according to <11>, wherein a depth of the first UV-curable resin penetrating into a surface, which extends from an edge of the tip ridgeline portion in a direction towards a fixed end of the elastic body blade, is 20 μm to 100 μm.

This application claims priority to Japanese application No. 2014-157415, filed on Aug. 1, 2014 and incorporated herein by reference.

What is claimed is:

1. A cleaning blade, comprising:

a rectangular elastic body blade, wherein the elastic body blade contains a cured first UV-curable resin at a tip ridgeline portion thereof, which is brought into contact with a surface of a member to be cleaned, where the cured first UV-curable resin is formed by impregnating the tip ridgeline portion of the elastic body blade with the first UV-curable resin, followed by curing the first UV-curable resin, and a depth of the elastic body blade impregnated with the first UV-curable resin from an edge surface thereof is 50 μm to 150 μm, wherein the elastic body blade contains a surface layer containing a cured second UV-curable resin at the edge surface thereof, wherein a load-displacement curve of a Martens hardness of the elastic body blade has inflection points, where the load-displacement curve is obtained by pressing a region of the surface layer of the elastic body blade via resin particles having an average particle diameter of 5 μm to 10 μm, and a distance of the region of the surface layer from the tip ridgeline portion is 0.5 mm or less, and wherein a ratio of a displacement at the inflection point, at which a load based on pressing the region of the surface layer of the elastic body blade via the resin particles is at a maximum, to the average particle diameter of the resin particles is 1.5 to 2.0.

2. The cleaning blade according to claim 1, wherein a depth of the first UV-curable resin penetrating into a surface, which extends from an edge of the tip ridgeline portion in a direction towards a fixed end of the elastic body blade, is 20 μm to 100 μm.

3. The cleaning blade according to claim 1, wherein the surface layer has a thickness of 2 μm or less.

4. The cleaning blade according to claim 1, wherein the first UV-curable resin, or the second UV-curable resin, or both contain a trifunctional to hexafunctional acrylic monomer having a functional group equivalent weight of 350 or less, and containing a residue derived from pentaerythritol, and a monofunctional to bifunctional acrylic monomer having a functional group equivalent weight of 100 to 1,000.

5. The cleaning blade according to claim 1, wherein the first UV-curable resin, or the second UV-curable resin, or both contain a bifunctional or higher acrylic monomer having a perfluoropolyether skeleton.

6. The cleaning blade according to claim 1, wherein the first UV-curable resin and the second UV-curable resin are identical.

7. The cleaning blade according to claim 1, wherein the elastic body blade contains urethane rubber.

8. The cleaning blade according to claim 7, wherein the elastic body blade is a laminate of two different types of urethane rubber.

9. An image forming apparatus, comprising:

a photoconductor;

a charging unit configured to charge the photoconductor;

an exposing unit configured to expose the charged photoconductor to light to form an electrostatic latent image;

a developing unit configured to develop the electrostatic latent image formed on the photoconductor with a toner, to thereby form a toner image;

a transferring unit configured to transfer the toner image formed on the photoconductor to a recording medium; and a cleaning unit configured to clean the photoconductor from which the toner image has been transferred, wherein the cleaning unit contains a rectangular elastic body blade, wherein the elastic body blade contains a cured first UV-curable resin at a tip ridgeline portion thereof, which is brought into contact with a surface of a member to be cleaned, where the cured first UV-curable resin is formed by impregnating the tip ridgeline portion of the elastic body blade with the first UV-curable resin, followed by curing the first UV-curable resin, and a depth of the elastic body blade impregnated with the first UV-curable resin from an edge surface thereof is 50 μto 150 μm, wherein the elastic body blade contains a surface layer containing a cured second UV-curable resin at the edge surface thereof, wherein a load-displacement curve of a Martens hardness of the elastic body blade has inflection points, where the load-displacement curve is obtained by pressing a region of the surface layer of the elastic body blade via resin particles having an average particle diameter of 5 μm to 10 μm, and a distance of the region of the surface layer from the tip ridgeline portion is 0.5 mm or less, and wherein a ratio of a displacement at the inflection point, at which a load based on pressing the region of the surface layer of the elastic body blade via the resin particles is at a maximum, to the average particle diameter of the resin particles is 1.5 to 2.0.

10. The image forming apparatus according to claim 9, wherein a depth of the first UV-curable resin penetrating into a surface, which extends from an edge of the tip ridgeline portion in a direction towards a fixed end of the elastic body blade, is 20 μm to 100 μm.

11. A process cartridge, comprising:

a photoconductor; and a cleaning unit, wherein the process cartridge is detachably mounted in a main body of an image forming apparatus, wherein the cleaning unit contains a rectangular elastic body blade, wherein the elastic body blade contains a cured first UV-curable resin at a tip ridgeline portion thereof, which is brought into contact with a surface of a member to be cleaned, where the cured first UV-curable resin is formed by impregnating the tip ridgeline portion of the elastic body blade with the first UV-curable resin, followed by curing the first UV-curable resin, and a depth of the elastic body blade impregnated with the first UV-curable resin from an edge surface thereof is 50 μm to 150 μm, wherein the elastic body blade contains a surface layer containing a cured second UV-curable resin at the edge surface thereof, wherein a load-displacement curve of a Martens hardness of the elastic body blade has inflection points, where the load-displacement curve is obtained by pressing a region of the surface layer of the elastic body blade via resin particles having an average particle diameter of 5 μm to 10 μm, and a distance of the region of the surface layer from the tip ridgeline portion is 0.5 mm or less, and wherein a ratio of a displacement at the inflection point, at which a load based on pressing the region of the surface layer of the elastic body blade via the resin particles is at a maximum, to the average particle diameter of the resin particles is 1.5 to 2.0.

12. The process cartridge according to claim 11, wherein a depth of the first UV-curable resin penetrating into a surface, which extends from an edge of the tip ridgeline portion in a direction towards a fixed end of the elastic body blade, is 20 μm to 100 μm.

* * * * *